US005080143A

United States Patent [19]

Bertsch

[11] Patent Number: 5,080,143

[45] Date of Patent: Jan. 14, 1992

[54] SELVEDGING DEVICE WITH THREADING NOZZLE AND TUCK-IN NEEDLE

[75] Inventor: Gotthilf Bertsch, Ruti, Switzerland

[73] Assignee: Sulzer Brothers Limited, Winterthur, Switzerland

[21] Appl. No.: 643,797

[22] Filed: Jan. 22, 1991

[30] Foreign Application Priority Data

Jan. 23, 1990 [CH] Switzerland ..... 00212/90

[51] Int. Cl.[5] ..... D03D 47/48

[52] U.S. Cl. ..... 139/434

[58] Field of Search ..... 139/434, 430, 54, 302

[56] References Cited

U.S. PATENT DOCUMENTS 4,905,740 3/1990 Verclyte ..... 139/434
4,909,283 3/1990 Verclyte ..... 139/434 X
4,957,145 9/1990 Verclyte et al. ..... 139/434

FOREIGN PATENT DOCUMENTS 0293019 11/1988 European Pat. Off. .
0349039 1/1990 European Pat. Off. .
2249984 5/1975 France .
0472519 5/1969 Switzerland .
0624440 7/1981 Switzerland .

*Primary Examiner*—Andrew M. Falik
*Attorney, Agent, or Firm*—Kenyon & Kenyon

[57] ABSTRACT

A pneumatic selvedging device for a loom has a weft yarn end temporarily retained by a threading nozzle. A tuck-in needle takes over the retained weft yarn end for drawing in between the warp yarns of a loom. The threading nozzle is mounted on a retaining arm which is pivotally mounted on a shaft disposed within a casing above the cloth and near the beating-up edge for the weft yarn. A second drive shaft is mounted in the same casing transverse to the shaft for the retaining arm for driving the tuck-in needle. The shaft for the tuck-in needle and the shaft for the threading nozzle are driven off a common drive shaft via cams and cam follow-up levers. A shears may also be mounted on the retaining arm and be actuated by a link pivotally connected between a pivotal blade of the shears and the casing.

10 Claims, 3 Drawing Sheets

Figure 2C:
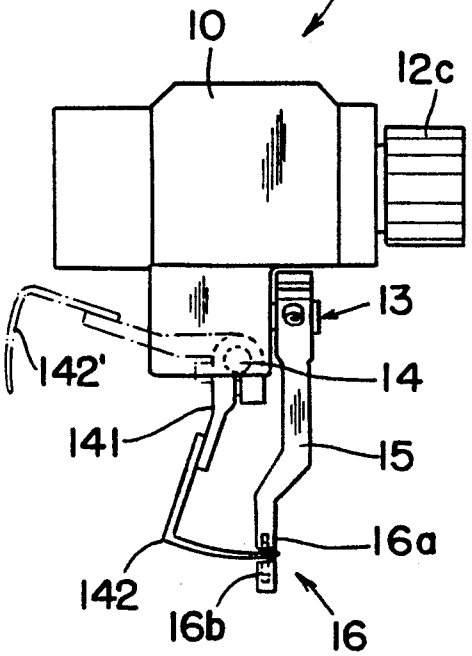

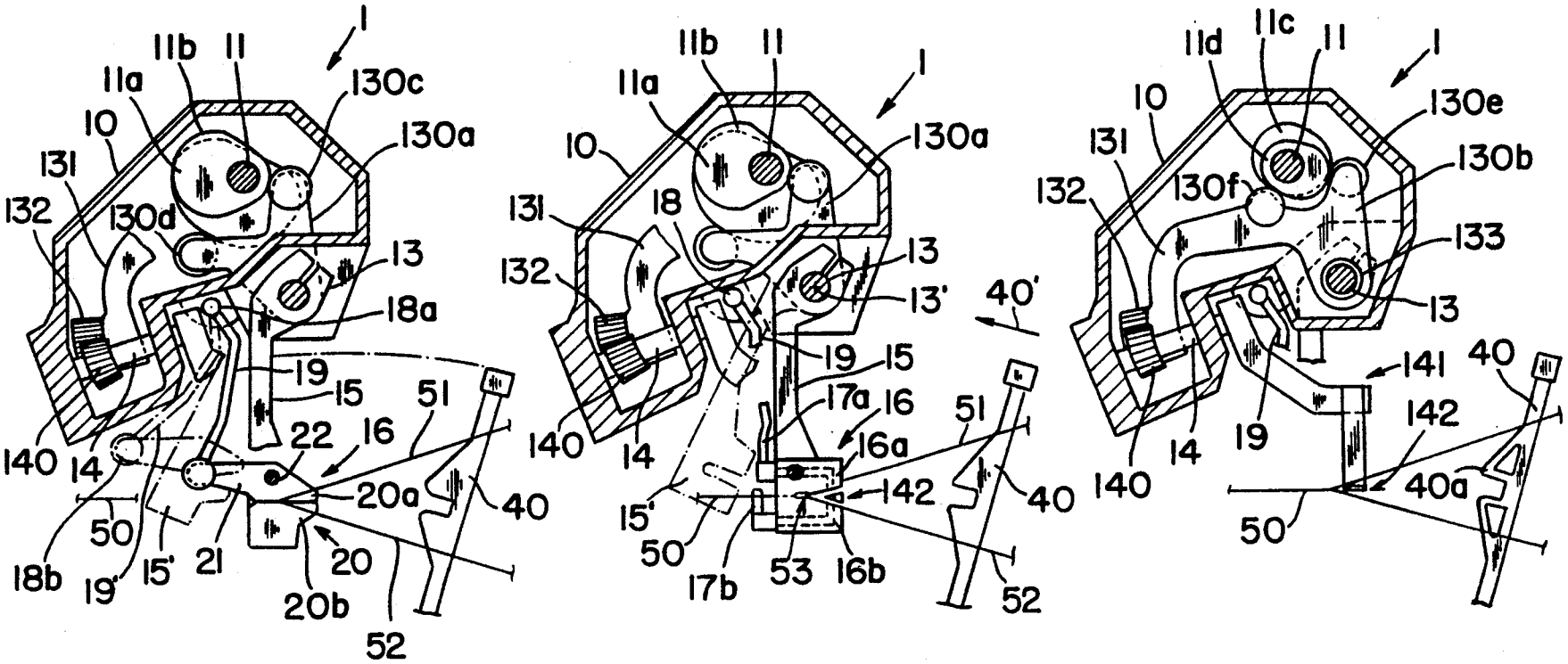
FIG. Ic.
FIG. Ib.
FIG. Ia.
1
10
11
11a
11b
11c
11d
13
13'
14
15
15'
16
16a
16b
17a
17b
18
18a
18b
19
19'
20
20a
20b
21
22
40
40'
40a
50
51
52
53
130a
130b
130c
130d
130e
130f
131
132
133
140
141
142

SELVEDGING DEVICE WITH THREADING NOZZLE AND TUCK-IN NEEDLE

This invention relates to a selvedging device for a loom and, more particularly, to a pneumatic selvedging device.

As is known, various types of selvedging devices have been employed for the tucking in of a picked weft yarn in order to form a selvedge along an edge of a cloth. For example, European Patent 0149969 describes a selvedging device which includes a threading nozzle which is mounted on a carrier and driven in a reciprocating manner relative to a shed of warp yarns and a weft yarn shears which has a special drive in order to sever the weft yarn so that the end of the weft yarn can be held within the threading nozzle. In addition, the selvedging device employs a tuck-in needle which makes a pivoting motion relative to the threading nozzle and which also requires a separate drive. Such a selvedging device, however, requires relatively expensive and bulky components in order to produce the various movements of the threading nozzle, shears and tuck-in needle, some of which movements are translational.

Other types of selvedging devices have also been known such as described in European Patent Application 0349039 in which a pneumatic thread holder is provided to hold a picked weft yarn in a position to permit a tuck-in needle to insert the end of the weft yarn into a shed. However, relatively complex transmissions are required in order to provide for synchronism between the thread holder and the tuck-in needle.

Other types of relatively complex selvedging ices have also been described in European Patent Application 0293019, Swiss Patent 624,440, Swiss Patent 472,519 and French Patent 2,249,984.

Accordingly, it is an object to the invention to provide a compact selvedging device having very simple drive elements.

It is another object to the invention to provide a selvedging device of relatively inexpensive construction.

It is another object to the invention to simplify the construction of a selvedging device for a loom.

Briefly, the invention provides a selvedging device for a loom which is comprised of a casing for mounting above a cloth-forming position in a loom and a pair of rotatable shafts which are mounted in the casing. One shaft is mounted on a first axis of rotation parallel to a picking direction in the loom while the second shaft is mounted on a second axis of rotation transverse to the first axis.

In addition, a retaining arm is mounted on the shaft parallel to the picking direction for pivoting about the axis thereof while a threading nozzle is mounted on the arm for temporarily retaining a weft yarn end which projects from a shed of warp yarns in the loom. A tuck-in needle is mounted on the second shaft for pivoting about the axis thereof in order to move between a threading position adjacent the threading nozzle in order to receive a weft yarn end therefrom and a rest position spaced from the threading position in order to tuck the weft yarn end into the shed of warp yarns.

The selvedging device is constructed so as to be mounted adjacent one end of a reed for beating a weft yarn in the shed of warp yarns into a cloth at a beating-up position. In addition, the shaft for mounting the retaining arm is disposed above the beating-up position.

The selvedging device also includes a common drive shaft which is mounted in the casing in parallel to the axis of the retaining arm shaft. This drive shaft is articulated to the two shafts in order to drive the two shafts in synchronism. This common drive shaft also carries a plurality of cams through which movements are transmitted by way of cam follower levers to the retaining arm shaft and the tuck-in needle shaft.

The selvedging device may also include a shears on the retaining arm for severing a weft yarn extending from the threading nozzle. For example, the shears may include a bottom blade fixedly mounted on the retaining arm and a top blade pivotally mounted on the retaining arm. In addition, a link is pivotally mounted at one end on the casing while being pivotally mounted at an opposite end to the top blade. Thus, upon pivoting of the retaining arm, the link causes the top blade to move relative to the bottom blade of the shears to effect severing of a weft yarn. No additional drive or mounting is therefore required for the shears.

The selvedging device is so compact that the dimensions of the device with the casing are reduced to such a extent that disposition of the device above the weaving plane of the loom does not cause any disturbance. The selvedging device can be devised for the picking side and/or catching side of the loom, as well as a separating selvedging device between the picking side and the catching side of the loom.

Figure 2B:
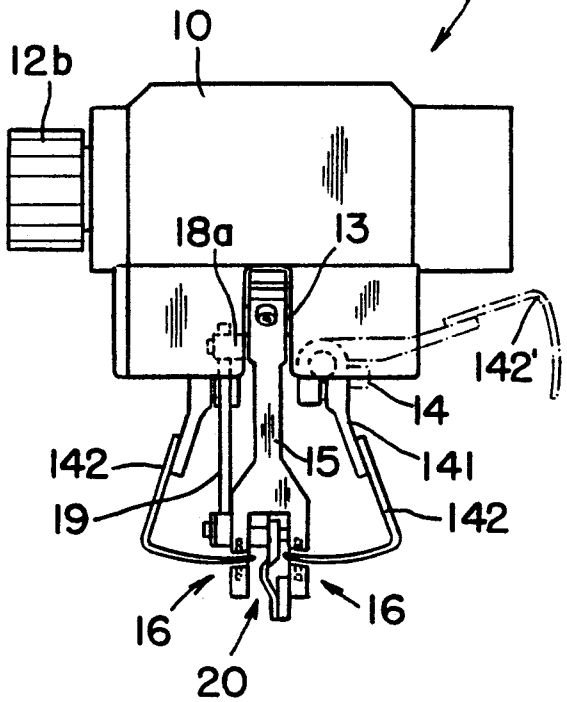
Figure 2A:
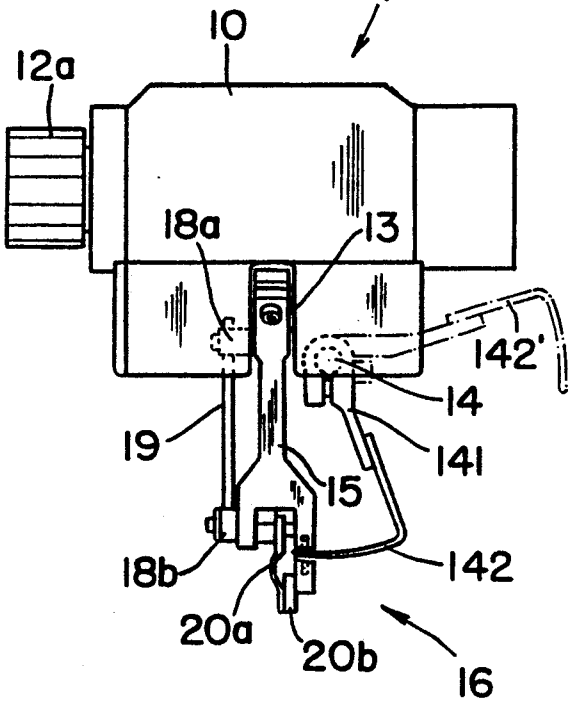
Figure 3A:
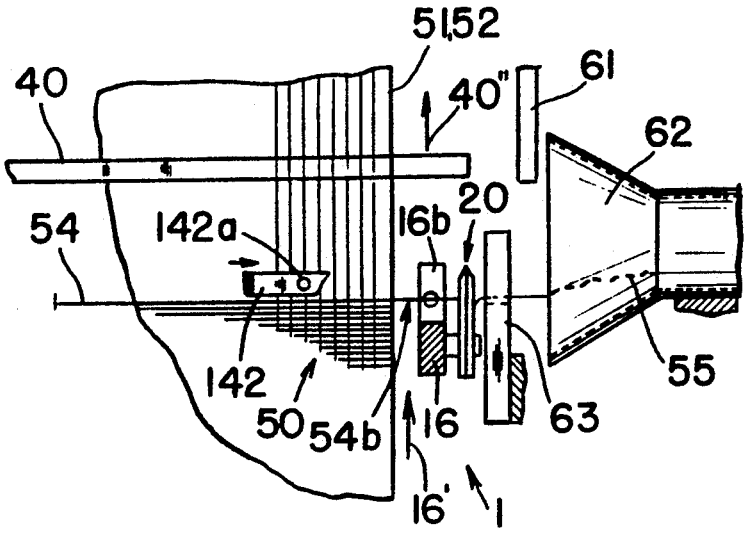
Figure 3B:
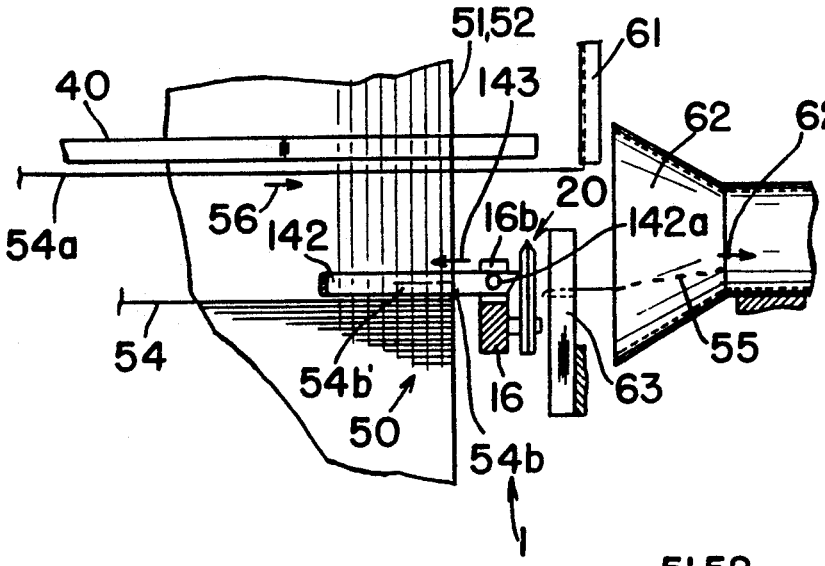
Figure 3C:
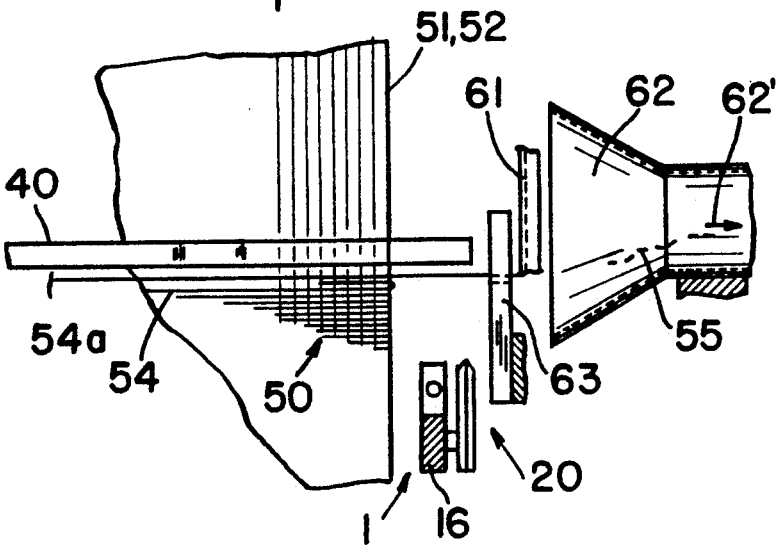

These and other objects and advantages of the invention will become more apparent from the following detailed description taken in conjunction with the accompanying drawings wherein:

FIG. 1*a* illustrates a cross-sectional view through a selvedging device in accordance with the invention;

FIG. 1*b* illustrates a view similar to FIG. 1*a* of a further cross-section of the selvedging device in accordance with the invention;

FIG. 1*c* illustrates a cross-sectional view of the drive for the tuck-in needle of the selvedging device;

FIG. 2*a* illustrates a front view of the selvedging device for the picking side of a loom;

FIG. 2*b* illustrates a modified selvedging device employed at an intermediate point in a loom;

FIG. 2*c* illustrates a front view of a selvedging device with shears in accordance with the invention;

FIG. 3*a* schematically illustrates the selvedging device of FIG. la during one phase of operation of a loom;

FIG. 3*b* illustrates the positions of the various components of the selvedging device of FIG. 1*a* prior to tucking in of a weft yarn end; and FIG. 3*c* illustrates a view similar to FIG. 3*a* of the position of the selvedging device components after a second pick has been made.

Referring to FIG. 1*a*, the selvedging device 1 is to be mounted downstream of a reed 40 and above a beating-up position of a weft yarn within a shed formed by top warp yarns 51 and bottom warp yarns 52.

As illustrated, the selvedging device 1 has a casing 10 which is mounted above the cloth-forming position of the loom. In addition, the casing 10 houses a common drive shaft 11 on which cams 11*a*, 11*b* are secured for purposes as described below. In addition, a second shaft 13 is pivotally mounted in the casing 10 on an axis parallel to the common drive shaft 11 as well as parallel to a picking direction of a weft yarn in the loom. As indicated, the shaft 13 carries a cam follower lever 130*a* which, in turn, carries a pair of cam rollers 130*c*, 130*d* which engage the cams 11*a*, 11*b* in abutting relation. Thus, upon rotation of the drive shaft 11, the shaft 13 is caused to pivot in synchronism Referring to FIGS. 1*a* and 2*a*, a retaining arm 15 is mounted on the shaft 13 for pivoting about the axis of the shaft 13, for example, between the solid line position shown in FIG. 1*a* and the dotted line position shown in FIG. 1*a*. The retaining arm 15 also carries a shears 20 at the lower end for severing a weft yarn. As indicated, the shears 20 includes a top blade 20*a* which is pivotally mounted on a bearing pin 22 on the arm 15 and a bottom blade 20*b* which is fixedly mounted on the arm 15. In addition, a link 19 is pivotally mounted at an upper end by way of pivot 18*a* to the casing 10 while the opposite end is pivotally mounted by way of a pivot 18*b* on an arm 21 of the top blade 20*a* of the shears 20. Thus, upon pivoting of the retaining arm between the two positions illustrated in FIG 1*a*, the link 19 causes the shears 20 to open and close.

Referring to FIGS. 1*b* and 2*a*, a threading nozzle 16 is mounted on the arm 15 astride the shears 20 for temporarily retaining a weft yarn end projecting from the shed of warp yarns in the loom. As illustrated, the thread carrier 16 has a top threading nozzle 16*a* and a bottom threading nozzle 16*b*, each connected to a respected tube 17*a*, 17*b* through which air at a positive or a negative pressure can be introduced by choice. As indicated in FIG. 3*b*, after severance of a weft yarn tip 55, a weft yarn end 54*b* is drawn into the top nozzle 16*a* or into the bottom nozzle 16*d*, depending upon which of the two nozzles is being flowed through by air at a positive pressure or at a negative pressure. For example, air at a negative pressure blows the weft yarn and 54*a* from the nozzle 16*a* into the nozzle 16*b* in which air is drawn in through the tube 17*b*. In this case, the weft yarn end 54*b* will find its way into the bottom tube 16*b* once the nozzle carrier 16 has been moved above the weft yarn 54.

Referring to FIG. 1*a*, the selvedging device also has a second shaft 14 pivotally mounted in the casing 10 on a second axis transverse to the axis of the shaft 13. The shaft 14, as indicated in FIG. 1*c*, has a tuck-in needle 142 mounted thereon via a lever 141 for pivoting about the axis of the shaft 14 (see FIG. 2*a*) in order to move between a threading position adjacent to the threading nozzle 16*a*, 16*b* to receive a weft yarn and a rest position spaced from the threading position. The shaft 14 is also articulated to the main drive shaft 11 via a cam follower lever 131 which extends from a cam follower lever 130*b*, in turn, mounted by means of a rolling bearing 133 on the shaft 13. The lever 130*b* also carries a pair of cam rollers 130*e*, 130*f*, which abuttingly engage against cams 11*c*, 11*d* on the drive shaft 11. The cam follow lever 130*b* also carries a toothed segment 132 which meshes with a bevel gear 140 on the shaft 14.

As will be apparent from FIG. 1*a*, the shaft 13 is substantially exactly above the intersection of the warp yarns 51, 52 through which intersection the beating-up edge 53 for the weft yarn extends as indicated in FIG. 1*b*. The formed cloth 50 extends horizontally to the left of the edge 53. The arm 15 with the nozzle carrier 16 is exposed adjacent to the cloth edge, i.e. on the picking side or catching side of the loom adjacent the cloth or, if there are a number of cloth webs, between the individual webs.

The reed 40 may be the reed of an air jet loom and may have lamellae formed with apertures 40*a* as shown in FIG. 1*c*.

During operation, when the retaining arm 15 pivots in a clockwise direction as viewed in FIG. 1*a*, around the axis of the shaft 13 from the chain line position 15' into the solid position 15, the pivot 18*b* moves into a higher position relative to the bearing pin 22 so that the blades 20*a*, 20*b* move towards one another to close the shears 20.

As will be apparent from FIGS. 1*a* to 1*c*, the drive shaft 14 for the tuck-in needle 142 form an acute angle with the plane of the cloth 50 with the drive shaft 14 rising, as viewed, from the cloth 50 towards the reed 40.

Once the tuck-in needle 142 is disposed with an eye between the top nozzle 16*a* and the bottom nozzle 16*b*, compressed air is introduced into the tube 17*b*. Thereafter, the weft yarn end 54*b* is blown through the eye of the needle 142 into the top nozzle 16*a*. The pressure operative at this time in the nozzle 16*a* is a negative pressure since air is being drawn away through the top tube 17*a*.

As will be apparent from FIG. 1*b*, the nozzles 16*a*, 16*b* can be moved from a left-hand position of the arm 15' into a right-hand position shown in solid line. The arm 15 with the carrier 16 must be pivoted back into the chain-dotted position 15' whenever the reed 40 pivots to the left, in the direction indicated by the arrow 40' as far as the beating-up edge 53 for the reed.

When the drive shaft 11 pivots the cam follower lever 130*b*, the lever arm 131 therefore shifts the toothed segment 132 relative to the bevel gear 140 so that the drive shaft 14 and articulated arm 141 and needle 142 are pivoted.

Referring to FIG. 2*a*, the tuck-in needle 142 is moveable from the solid line position illustrated in which a weft yarn end (not shown) can be transferred to the carrier 16 to the needle 142. The chain-dotted position 142' which indicates the rest position of the needle 142 is outside the shed. As indicated, a gear 12*a* is disposed outside the casing 10 on the common drive shaft (not shown). This gear 12*a* can be driven off another continuous shaft.

The embodiment of FIG. 2*b* differs from the embodiment of FIG. 2*a* in that the needle 142 and the articulated drive are duplicated as is the nozzle carrier 16. In this case, a single shears 20 is disposed between the two nozzle carriers 16. This embodiment of the selvedge device is used when a number of cloth webs are being woven on a loom in parallel to one another.

The embodiment of FIG. 2*c* has only a single nozzle 16 and a single tuck-in needle 142 with associated drives. In this case, separate shears are provided to sever the weft yarn tip before the weft yarn end 54*b* is tucked in by means of the needle 142.

As indicated in FIGS. 2*b* and 2*c*, gears 12*b*, 12*c* can be provided on the selvedging device.

Referring to FIG. 3*a*, after the reed 40 has beaten-up a weft yarn 54 at the edge of the cloth 50 and is on its way into the picking position, indicated by an arrow 40'', the tuck-in needle 142 is moving in an arc around the drive shaft 14 (see FIG. 2*a*). At this time, the needle 142 passes between the warp yarns 51, 52 and the eye 142*a* of the needle and approaches the nozzle carrier 16 which, in turn, is moving as indicated by the arrow 16'. Simultaneously, as the nozzle carrier 16 moves, the shears 20 are moving or pivoting towards the weft yarn in 54*b*. The yarn tip 55 is retained by a yarn clamp 63 into which the weft yarn 54 was introduced by means of the reed 40 and a stretching nozzle 61. The weft yarn tip 55 was previously in the nozzle 61 which draws air in from from the atmosphere and is now in an extraction tube 62 before severance by the shears 20.

Referring to FIG. 3*b*, after severance of the weft yarn 54, a second weft yarn 54*a* is picked into the shed in the direction indicated by the arrow 56 and is drawn into the nozzle 61. At this time, the shears 20 are in a closed state so that the yarn tip 55 has been severed and drawn through the tube 62 in the direction indicated by the arrow 62'. After severance of the tip 55, the end 54*b* is first blown into one of the threading nozzles 16*a*, 16*b* and then blown into the needle eye 142*a*. In the next step, the needle 142 moves back between the warp yarns 51, 52 as indicated by the arrow 143. Thereafter, the weft yarn end is in the position 54*b'* adjacent the weft yarn 54. The weft yarn end 54*b* is then secured in the tuck-in position by the next picked weft yarn 54*a* after beating-up thereof by the reed 40 (see FIG. 3*c*).

Referring to FIG. 3*c*, after beating-up of the next picked weft yarn 54*a*, the reed 40 contacts the top edge of the cloth 50. The nozzle carrier 16 and the shears 20 have been moved back a safe distance from the reed 40 to the positions indicated in chain-dotted line in FIG. 1*a*. The weft yarn tip 55 is removed through the extraction tube 62 in the direction indicated by the arrow 62'. When the reed 40 moves again in the direction indicated by the arrow 40'' (see FIG. 3*a*), the nozzle carrier 16 and shears 20 again move toward the last weft yarn 54*a* which has been picked to continue the cycle.

The invention thus provides a relatively compact selvedging device which employs relatively few parts in order to provide for the tucking-in of a weft yarn in a selvedge. The compact nature of the selvedging device permits the device to be arranged above the cloth in a loom without causing any disturbance.

What is claimed is:

1. A selvedging device for a loom comprising a casing for mounting above a cloth-forming position in a loom;

a first shaft mounted in said casing on a first axis of rotation parallel to a picking direction in the loom;

a retaining arm mounted on said shaft for pivoting about said first axis;

a threading nozzle mounted on said arm for temporarily retaining a weft yarn end projecting from a shed of warp yarns in the loom;

a second shaft mounted in said casing on a second axis of rotation transverse to said first axis; and a tuck-in needle mounted on said second shaft for pivoting about said second axis to move between a threading position adjacent said threading nozzle to receive a weft yarn and therefrom and a rest position spaced from said threading position.

2. A device as set forth in claim 1 which further comprises a common drive shaft mounted in said casing in parallel to said first axis, said drive shaft being articulated to said first shaft and said second shaft to drive said shafts in synchronism

3. A device as set forth in claim 2 wherein said drive shaft has a plurality of cams thereon and which further comprises a first cam follower lever secured to said first shaft and being in abutting engagement with one of said cams to drive said first shaft in response to rotation of said drive shaft and a second cam follower lever secured to said second shaft and being in abutting engagement with another of said cams to pivot said second shaft in response to rotation of said drive shaft.

4. A device as set forth in claim 3 which further comprises a toothed segment on said second cam follower lever and a bevel gear on said second shaft in meshing engagement with said segment.

5. A device as set forth in claim 1 which further comprises a shears on said retaining arm for severing a weft yarn extending from said threading nozzle.

6. A device as set forth in claim 5 wherein said shears includes a bottom blade fixedly mounted on said retaining arm and a top blade pivotally mounted on said retaining arm and which further comprises a link pivotally mounted at one and on said casing and pivotally mounted at an opposite end to said top blade.

7. A device as set forth in claim 1 wherein said second shaft is angularly disposed to a horizontal plane to define an acute angle with the cloth formed in the loom.

8. In a loom, the combination comprising a reed for beating a weft yarn in a shed of warp yarns into a cloth at a beating-up position; and a selvedging device mounted adjacent one end of said reed for tucking a weft yarn end into the shed, said device including a casing, a first shaft mounted in said casing on a first axis of rotation parallel to a picking direction in the loom;

a retaining arm mounted on said shaft for pivoting about said first axis;

a threading nozzle mounted on said arm for temporarily retaining a weft yarn end projecting from a shed of warp yarns in the loom;

a second shaft mounted in said casing on a second axis of rotation transverse to said first axis; and a tuck-in needle mounted on said second shaft for pivoting about said second axis to move between a threading position adjacent said threading nozzle to receive a weft yarn and therefrom and a rest position spaced from said threading position.

9. The combination as set forth in claim 8 wherein said first shaft is disposed above said beating-up position.

10. The combination as set forth in claim 8 wherein said threading nozzle is movable in a plane perpendicular to said reed between a rest position remote from said beating-up position and a threading position at said beating-up position.

* * * * *

UNITED STATES PATENT AND TRADEMARK OFFICE

CERTIFICATE OF CORRECTION

PATENT NO. : 5,080,143

DATED : January 14, 1992

INVENTOR(S) : Bertsch, Gotthilf

It is certified that error appears in the above-identified patent and that said Letters Patent is hereby corrected as shown below:

Column 1, line 35, change "ices" to --devices--.

Column 2, line 25, change "a" to --an--.

Column 2, lines 28 and 29 change "separating" to --separate--.

Column 3 lines 27 and 28, change "respected" to --respective--.

Column 3 line 35, change "and" to --end--.

Column 5 line 54, change "and" to --end--.

Column 6 line 24, change "and" to --end--.

Column 6 line 47, change "and" to --end--.

Column 3 line 55, change "follow" to --follower--.

Signed and Sealed this

Twenty-second Day of February, 1994

*Attest:*

Bruce Lehman

BRUCE LEHMAN

*Attesting Officer*

*Commissioner of Patents and Trademarks*